US005454701A

United States Patent [19]

Chen

[11] Patent Number: 5,454,701

[45] Date of Patent: Oct. 3, 1995

[54] SCREW COMPRESSOR WITH ROTORS HAVING HYPER PROFILE

[76] Inventor: Chia-Hsing Chen, No. 485, Chung Cheng Road, Lu Chou Shiang, Taipei Hsien, Taiwan, Prov. of China

[21] Appl. No.: 253,163

[22] Filed: Jun. 2, 1994

[51] Int. Cl.[6] ..... F01C 1/16

[52] U.S. Cl. ..... 418/201.3

[58] Field of Search ..... 418/150, 201.3

[56] References Cited

U.S. PATENT DOCUMENTS 4,695,233 9/1987 Miyoshi et al. ..... 418/201.3

4,890,992 1/1990 Lee ..... 418/201.3

5,066,205 11/1991 Ingalls ..... 418/201.3

*Primary Examiner*—Richard A. Bertsch

*Assistant Examiner*—Charles G. Freay

[57] ABSTRACT

A screw compressor having a female rotor and a male rotor which perfectly mesh with each other through their profiles generated by a plurality of continuously connected curves which are so determined that the working efficiency of the screw compressor can be increased and the mechanical loss thereof can be reduced through the rotation and mesh of the female and the male rotors.

4 Claims, 3 Drawing Sheets

SCREW COMPRESSOR WITH ROTORS HAVING HYPER PROFILE

BACKGROUND OF THE INVENTION

1. Field of the Invention

The present invention relates to the generation of profiles for the rotors of a screw compressor, and more particularly to the generation of profiles for the female rotor and the male rotor of a screw compressor which give an optimum relation between the two rotors and thereby increase the working efficiency of the screw compressor and reduce the mechanical loss thereof.

2. Description of the Prior Art

Generally speaking, a screw compressor is provided with a male rotor and a female rotor which intermesh with each other when they rotate. These screw rotors are asymmetrical in their contour and usually have considerably complicate profiles. To improve the working performance of such compressor and the techniques used to produce such compressor, various kinds of problems are faced by the designers. For example, to improve the working efficiency of the rotors, it is necessary to take into account of the rotors, the dimensions and clearance tolerance of housing in which the rotors work, the length of sealing line, and the area of the blow hole.

It is a common way for the conventional screw compressor to reduce the area of the blow hole to increase the working efficiency thereof. However, the area of the blow hole is not the only factor which has influence on the working efficiency and the production technique of the screw compressor. First, the length of the sealing line affects the working efficiency, too. By the sealing line, it means the contact line between the rotors. When the sealing line is too long, the clearance between the rotors increases and thereby reduces the working efficiency of the compressor. Secondly, when the blow hole is too large, fluid in the compressor will leak from the high-pressure chamber into the low-pressure chamber therein and thereby reduces the working efficiency, too. In addition, the profile of rotors also largely affects the working efficiency of the compressor.

As to the technique used to produce the compressor rotors, better quality toothed cutters, higher accuracy achieved at lower cost, and prolonged cutter life, all are necessary conditions to be considered.

In view that the profile of rotors has great influence on the efficiency of the screw compressor, it is therefore tried by the inventor to develop a new method to generate the profiles that give the rotors of the compressor the optimum working efficiency.

SUMMARY OF THE INVENTION

It is therefore a primary object of the present invention to provide the female and the male rotors of the screw compressor with perfectly meshed profiles which reduce the blow hole area and increase the compression efficiency while enhance the efficiency in producing the compressor.

Another object of the present invention is to provide the female and the male rotors of the screw compressor with optimum profiles which minimize the mechanical loss between the rotors.

A further object of the present invention is to provide the rotors of the screw compressor with profiles which may increase the cutting accuracy and prolong the usable life of the cutters.

BRIEF DESCRIPTION OF THE DRAWINGS

The detailed structure, applied principles, functions and benefits of the present invention may be best understood through the following detailed description of the preferred embodiment and the accompanying drawings, wherein.

DETAILED DESCRIPTION OF THE PREFERRED EMBODIMENT

Figure 1:
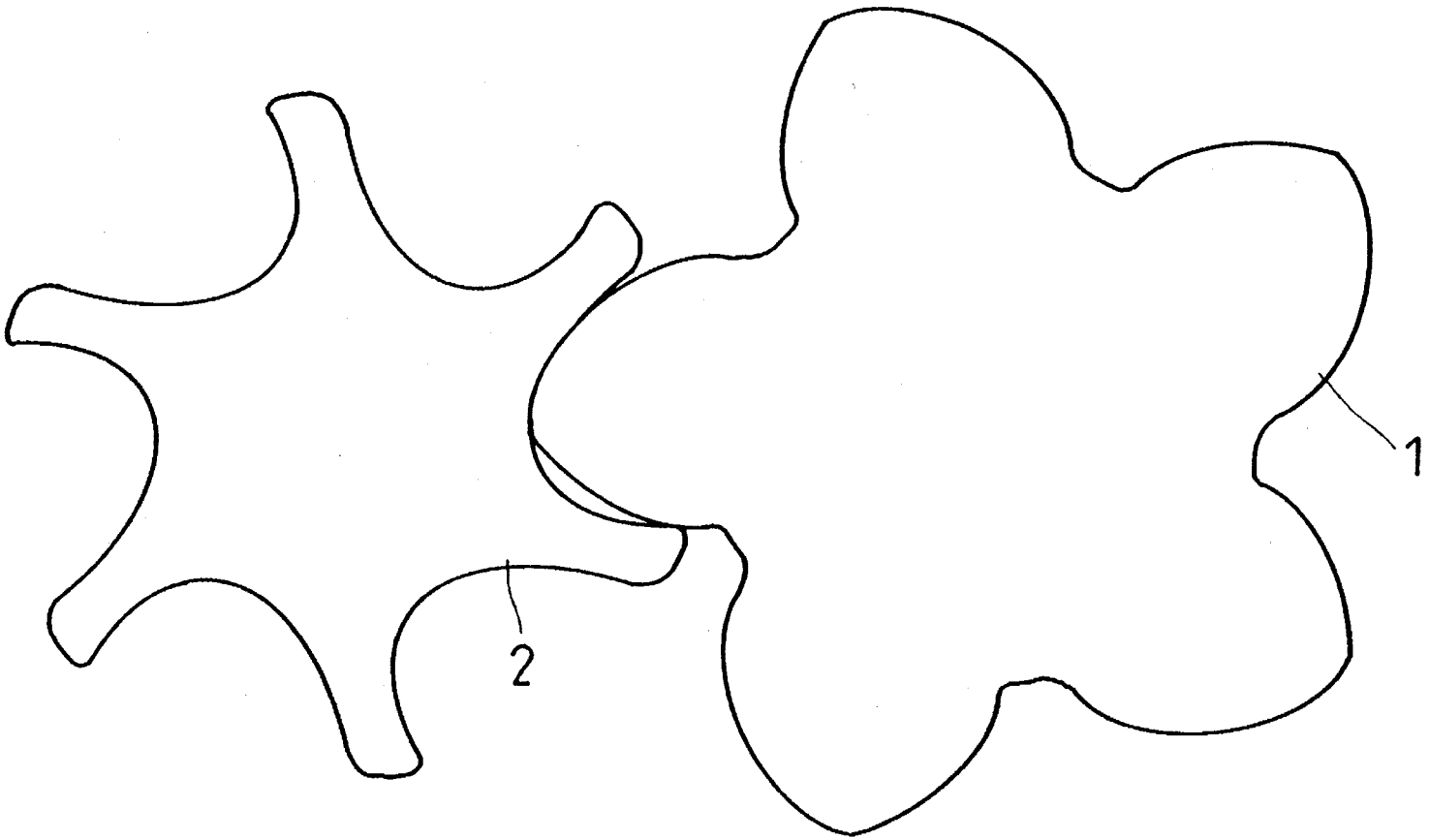
FIG. 1 illustrates the meshing of a male rotor and a female rotor having the profile defined according to the present invention.

FIG. 1 illustrates a male rotor 1 and a female rotor 2 in a screw compressor. The mesh of these rotors while they rotate shall control the flow of fluid coming in and out of the compressor.

Figure 2:
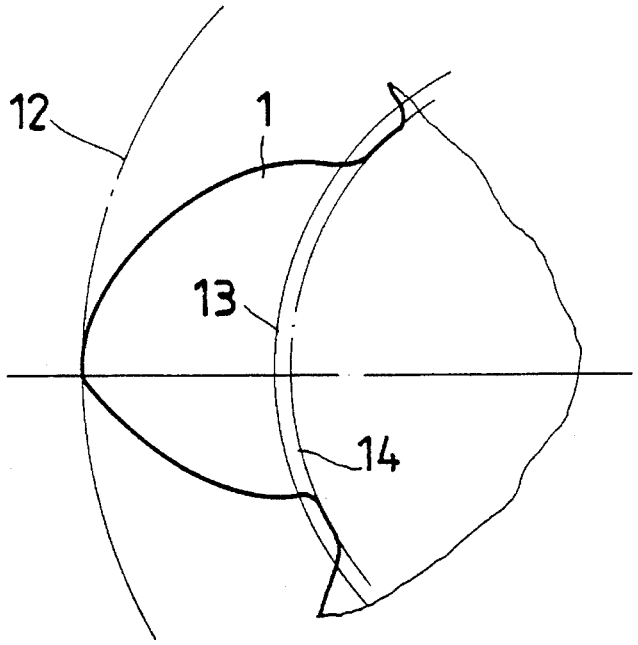
FIG. 2 is a partial line drawing of a male rotor having the profile defined according to the present invention.
Figure 3:
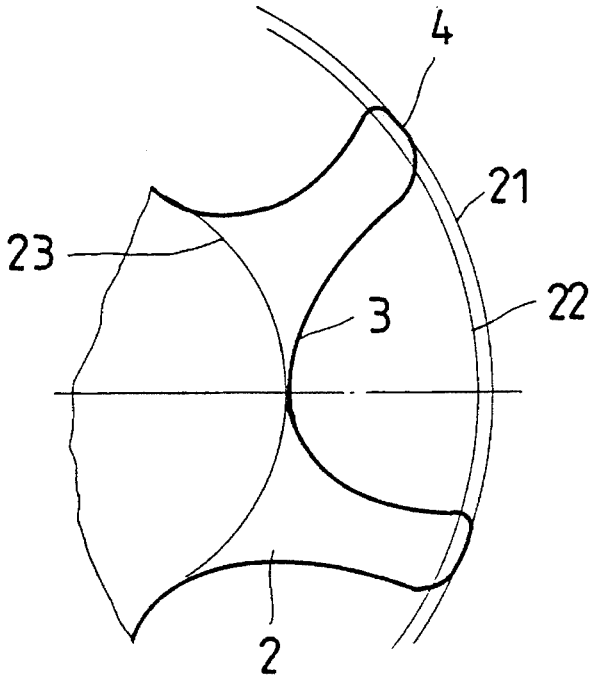
FIG. 3 is a partial line drawing of a female rotor having the profile defined according to the present invention.

Please refer to FIGS. 2 and 3 for the detailed structure of the male and the female rotors 1, 2. The male rotor 1 has an addendum circle 12, a pitch circle 13, and a dedendum circle 14; the female rotor 2 also has an addendum circle 21, a pitch circle 22, and a dedendum circle 23. The female rotor 2 further has a plurality of tooth grooves 3 and a like number of tooth ribs 4. The tooth grooves 3 each is formed from a plurality of continuously connected curves.

Figure 4:
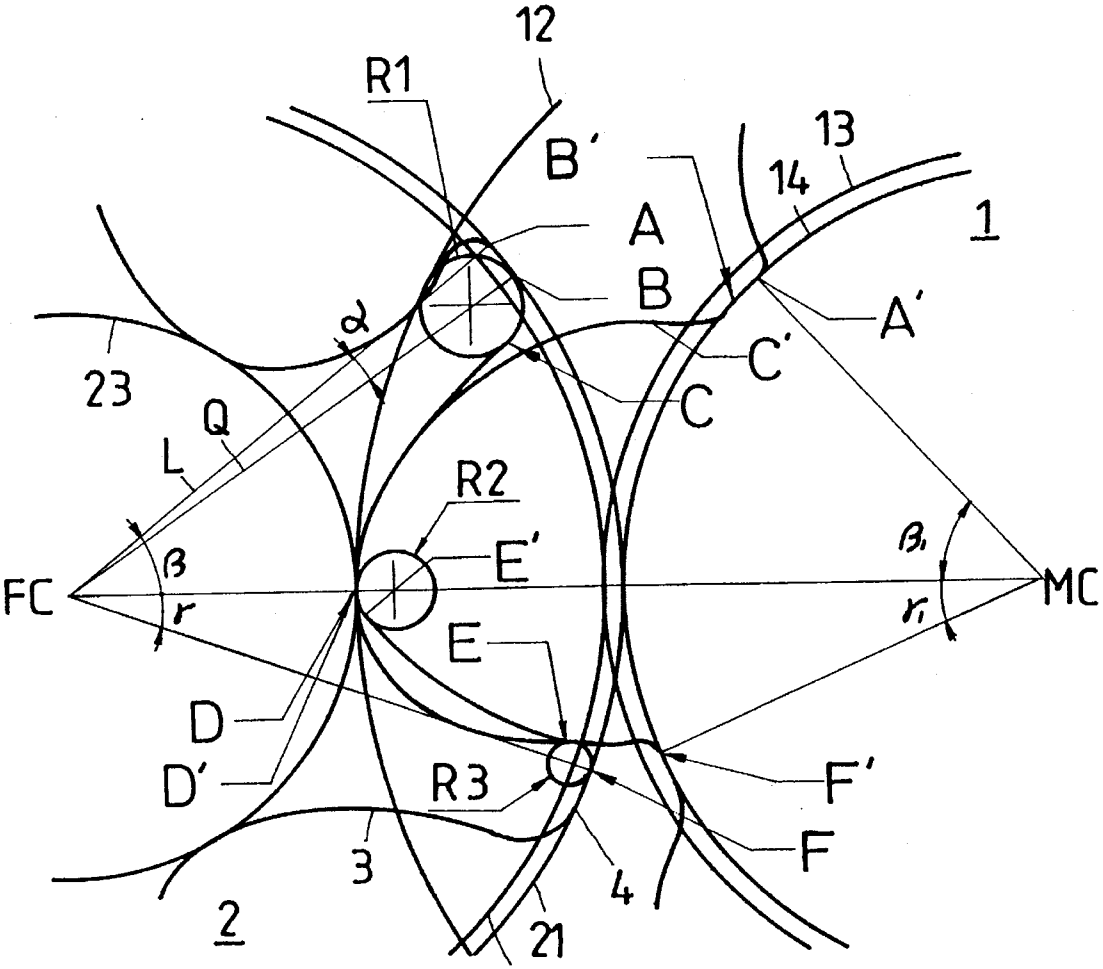
FIG. 4 is an enlarged view showing the manner in which the curves forming the profile of the male and the female rotors are generated.

What to be noted is all the curves forming the profile of the screw rotors shown in the drawings are defined by the right hand coordinate system. The male rotor 1 and the female rotor 2 of the screw compressor separately rotates about their axis with their profiles meshing with each other. The cut plane of mesh of these rotors are shown in FIG. 4. The female rotor 2, that is shown at the left hand of FIG. 4, has a center FC, and the male rotor 1, that is shown at the right hand of FIG. 4, has a center MC.

The center FC, the addendum circle 21, the pitch circle 22, and the dedendum circle 23 together define a complete profile for the female rotor 2. The female rotor 2 has a plurality of tooth grooves 3 and a like number of tooth ribs and accordingly rib crests 4. The profile of the tooth grooves 3 and the tooth ribs 4 is formed from a plurality of continuously connected curves. Among these curves, curve CD is a right half of a hyperbola 6E (that is, $Y \geqq YC$ and $X \geqq XC$. As to the forming of the hyperbola 6E, according to the Cartesian Coordinates System, a laterally symmetrical hyperbola is defined by the following formula:

$$(x-xc)^2/a^2-(y-yc)^2/b^2=1$$

wherein a=½ of the length of the real axis of the hyperbola 6E the value of a is approximately 0.4x to 0.8x, where x is defined as the distance between the centers of the male and female rotors;

b=½ of the length of the virtual axis; and the value of b/a is between 0.5 and 0.6; when the eccentricity of the hyperbola 6E ranges between 1.1 and 1.2, the preferred profile will be generated.

The real axis of the hyperbola is located on the line segment formed between two centers of the male and female rotors. The center (xc, yc) of the hyperbola is located on the left side of the center of the female rotor; that is, the distance from the center of the hyperbola to the center of the female rotor is equal to the radius of the deddendum of the female rotor.

Draw a line L from the center FC of the female rotor 2 to intersect the addendum circle 21 of the female rotor 2 at point A; draw a line Q such that it together with the line L contain an adequate angle α about 1° to 5° between them. The line Q intersects the addendum circle 21 of the female rotor 2 at point B. Draw a circle R1 such that it has a circle center locating on the line segment between the center FC of the female rotor 2 and the point B and is externally tangent to a curve CD at point C. The radius of the circle R1 is approximately 0.04X to 0.1X, wherein, X is the distance between the two centers FC, MC. By this way, arc BC forms a part of the profile of the female rotor 2, and curve AB is a part of the addendum circle 21 of the female rotor 2 and corresponds to the angle α about 1° to 5°. Curve DE is generated by an arc D'E' on the male rotor 1 and is a part of a circle R2; arc EF is a part of a circle R3 which has a circle center located on the line segment between FC and point F. Line segment FC-F is drawn from the center FC of the female rotor 2 and contains together with the line segment between FC and MC an angle γ. Circle R3 is externally tangent to the addendum circle 21 of the female rotor 2 at point F, and to the curve DE at point E, so that the arc EF forms a part of the profile of the female rotor 2.

The addendum circle 12, the pitch circle 13, and the dedendum circle 14 together define a complete profile of the tooth lobe of the male rotor 1 contained by angles β1 and γ1. Curve A'B' is generated by the arc AB on the female rotor 2 and is a part of the dedendum circle 14 of the male rotor 1. Curve B'C' is generated by the arc BC of the female rotor 2, and curve C'D' is generated by the curve CD of the female rotor 2. The arc D'E' is a small arc (a part of the circle R2) having a circle center located on the line segment between the centers FC and MC of the female and the male rotors 2, 1, respectively. The small arc D'E' is tangent to the curve C'D' at point D', and to a curve E'F' at point E'. The curve E'F' is generated by an arc EF on the female rotor 2. The dedendum circle 14 of the male rotor 1 is tangent to the curve E'F' at point F', and the curve E'F' is tangent to the small arc D'E' at point E'.

In consideration of the difficulty for machining, the wearing of cutters, and the higher working efficiency (that is, a low wearing and a small blow back hole), the ratio of the length of radius of circle R2 to that of circle R3 (R2/R3) is preferably between 1 and 2 to generate the preferred result.

From the above, the arc AB, the arc BC, the curve CD, the curve DE, and the arc EF together form a complete tooth rib profile of the female rotor 2, and, the curve A'B', the curve B'C', the curve C'D', the small arc D'E', and the curve E'F' together form the complete tooth lobe profile of the male rotor 1, permitting the two profiles to perfectly mesh with each other. Such perfectly meshed profiles are the so-called hyper profile.

The angle α (1°–5°) of the arc AB can be decided depending on the need of machining. This range of angle α may effectively provide good support to the cutter during machining so that the cutter is not easily vibrated and thereby, the cutting precision and accuracy can be increased and the life of the cutter can be prolonged.

The profile curves generated according to the present invention for the female and the male rotors of the screw compressor may effectively reduce the blow hole area, enhance the compression and production efficiency, reduce the mechanical loss between the rotor profiles, upgrade the precision of cutting angles, and prolong the life of cutters, and thereby effectively eliminates the drawbacks existed in the conventional screw rotor profiles.

It is to be understood that the above description and drawings are only used for illustrating one embodiment of the present invention, not intended to limit the scope of the present invention. Any variation and derivation from the above description and drawings should be included in the scope of the present invention.

What is claimed is:

1. A screw compressor having a pair of intermeshing female rotor and male rotor which rotate about their respective axis and have profile respectively formed from a plurality of continuously connected curves, the profile of said female and said male rotors comprising:

first curve of said female rotor being formed from a part of an addendum circle of said female rotor and being located on said addendum circle of said female rotor;

a second curve of said female rotor being a part of a first circle and connecting with said first curve of said female rotor in a continuous manner; said first circle having a circle center inside a pitch circle of said female rotor;

a third curve of said female rotor being an upper half of a hyperbola and connecting with said second curve of said female rotor in a continuous manner; said third curve of said female rotor intersecting a line segment between the centers of said female and said male rotors and being tangent to a dedendum circle of said female rotor;

a fourth curve of said female rotor being generated by the fourth curve of the male rotor which is a part of the second circle and connecting with said third curve of said female rotor in a continuous manner; said second circle having a circle center located on said line segment between said centers of said female and said male rotors;

a fifth curve of said female rotor being generated by a third circle and being a part of said third circle, said fifth curve of said female rotor being formed on said addendum circle of said female rotor and connecting with said fourth curve of said female rotor in a continuous manner; said third circle having a circle center located on a line segment between said center of said female rotor and a point at where said third circle being tangent to said addendum circle of said female rotor;

a first curve of said male rotor being generated by said first curve of said female rotor and being a part of the dedendum circle of said male rotor;

a second curve of said male rotor being generated by said second curve of said female rotor and connecting with said first curve of said male rotor in a continuous manner;

a third curve of said male rotor being generated by said third curve of said female rotor and connecting with said second curve of said male rotor in a continuous manner;

a fourth curve of said male rotor being a small arc which is a part of said second circle; and a fifth curve of said mate rotor being generated by said fifth curve of said female rotor and connecting with said fourth curve of said male rotor in a continuous manner.

2. A screw compressor as claimed in claim 1, wherein said second circle has a second radius and said third circle has a third radius, and the ratio of said second radius to said third radius being preferably in the range from 1:1 to 2:1.

3. A screw compressor as claimed in claim 1, wherein said first curve of said female rotor has a radian preferably in the range from about 1° to about 5°.

4. A screw compressor as claimed in claim 1, wherein said first circle has a first radius preferably about 0.04 to 0.1 times of said line segment between said center of said female rotor and said center of said male rotor.

* * * * *